United States Patent [19]

Wu et al.

[11] 4,033,303

[45] July 5, 1977

[54] ENGINE EXHAUST VALVE COOLING

[75] Inventors: Hai Wu, Northville; Charles M. Jones, Detroit, both of Mich.

[73] Assignee: Ford Motor Company, Dearborn, Mich.

[22] Filed: Feb. 25, 1976

[21] Appl. No.: 661,216

[52] U.S. Cl. ..... 123/41.85; 123/41.77; 123/188 S

[51] Int. Cl.[2] ..... F01P 3/12

[58] Field of Search ..... 123/41.85, 41.77, 188 S, 123/188 GC; 251/118

[56] References Cited

UNITED STATES PATENTS

| | | | |
|---|---|---|---|
| 1,512,952 | 10/1924 | Secor | 123/188 S |
| 1,873,119 | 8/1932 | Griswold | 123/188 S |
| 1,960,709 | 5/1934 | Olenick | 123/188 S |
| 2,074,859 | 3/1937 | Rich | 123/41.77 |
| 2,691,969 | 10/1954 | Stevens | 123/41.77 |
| 2,853,061 | 9/1958 | Elsbett | 123/41.85 |
| 3,127,880 | 4/1964 | Meurer | 123/41.85 |
| 3,285,235 | 11/1966 | Ueberschaer | 123/188 S |
| 3,385,053 | 5/1968 | Honda | 123/188 S |
| 3,653,368 | 4/1972 | Scherenberg | 123/188 S |
| 3,693,606 | 9/1972 | Hardenberg | 123/188 S |

*Primary Examiner*—Carroll B. Dority, Jr.
*Assistant Examiner*—Daniel J. O'Connor
*Attorney, Agent, or Firm*—John J. Roethel; Keith L. Zerschling

[57] ABSTRACT

A cylinder head having an exhaust valve port comprising a throat defined by a wall of substantially circular cross section and a bevelled valve seat circumscribing the wall. The bevelled valve seat has an axially extending annular portion adapted to be engaged by a valve head to close the port, the bevelled valve seat extending axially outwardly from the axis of the throat at an angle to the wall. The improvement comprises the application of a small wall diverter within the exhaust port to force separation of the high temperature exhaust gas stream from the exhaust valve seat when the valve is open.

6 Claims, 4 Drawing Figures

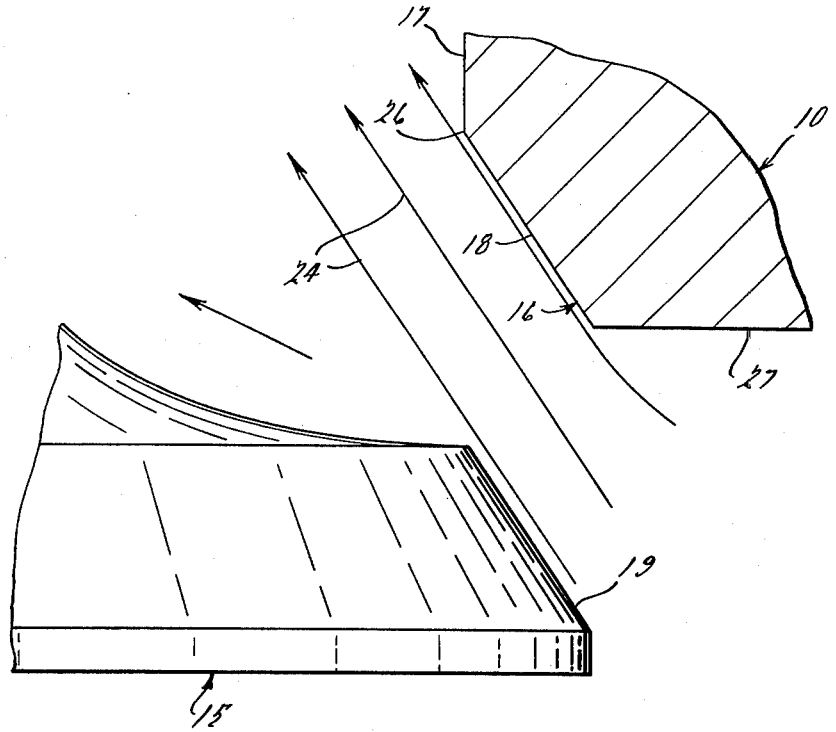
FIG. 3.
FIG. 4.
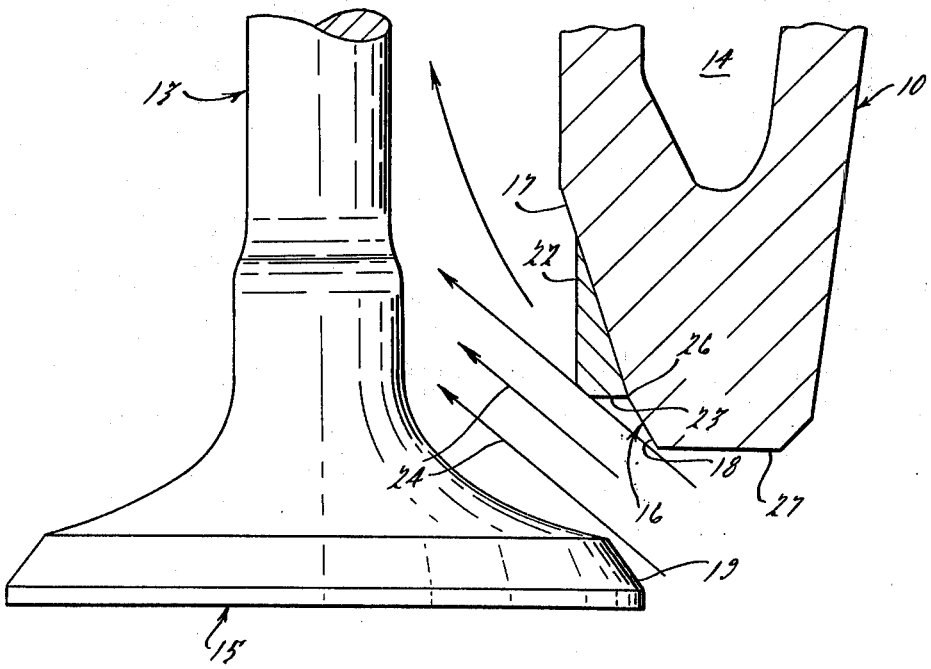

ENGINE EXHAUST VALVE COOLING

BACKGROUND OF THE INVENTION

When an internal combustion engine exhaust valve is open high temperature, high velocity, exhaust gas flows through a well defined passage bounded by the exhaust valve face and its seat. Attendant heat transfer film coefficients are very high and the exhaust valve seat and face are raised in temperature with the exhaust valve face temperature at least double that of a water jacketed exhaust valve seat temperature. When the gas flow is forced to separate from the valve seat, the resulting film coefficient is lowered and the seat operates at a lower temperature. Closure of the exhaust valve with attendant face-seat contact pressure lowers the exhaust valve face temperature.

SUMMARY OF THE INVENTION

The present invention relates to an engine cylinder head having an exhaust valve port comprising a throat defined by a wall of substantially circular cross section. A bevelled valve seat circumscribes the wall, the valve seat having an axially extending annular portion thereof adapted to be engaged by a valve head to close the port. The bevelled valve seat extends outwardly from the axis of the throat at an angle to the wall.

The improvement comprises an annular diverter means concentric with the axis of the wall. The diverter means is constructed and arranged to cause separation from the valve seat surface of exhaust gas flowing into the exhaust port between the valve head and the valve seat when the port is open. When the gas flow is forced to separate from the seat the resulting film coefficient is lowered and the seat operates at a lower temperature. Closure of the exhaust valve with attendent face-seat contact pressure lowers the exhaust valve face temperature.

DESCRIPTION OF THE DRAWINGS

Further features and advantages of the present invention will be made more apparent as this description proceeds, reference being had to the accompanying drawings, wherein:

FIG. 3 is a view in part similar to FIG. 2 illustrating a conventional exhaust port; and FIG. 4 is a view in part similar to FIG. 2 illustrating a further embodiment of the present invention.

DETAILED DESCRIPTION OF THE INVENTION

Figure 1:
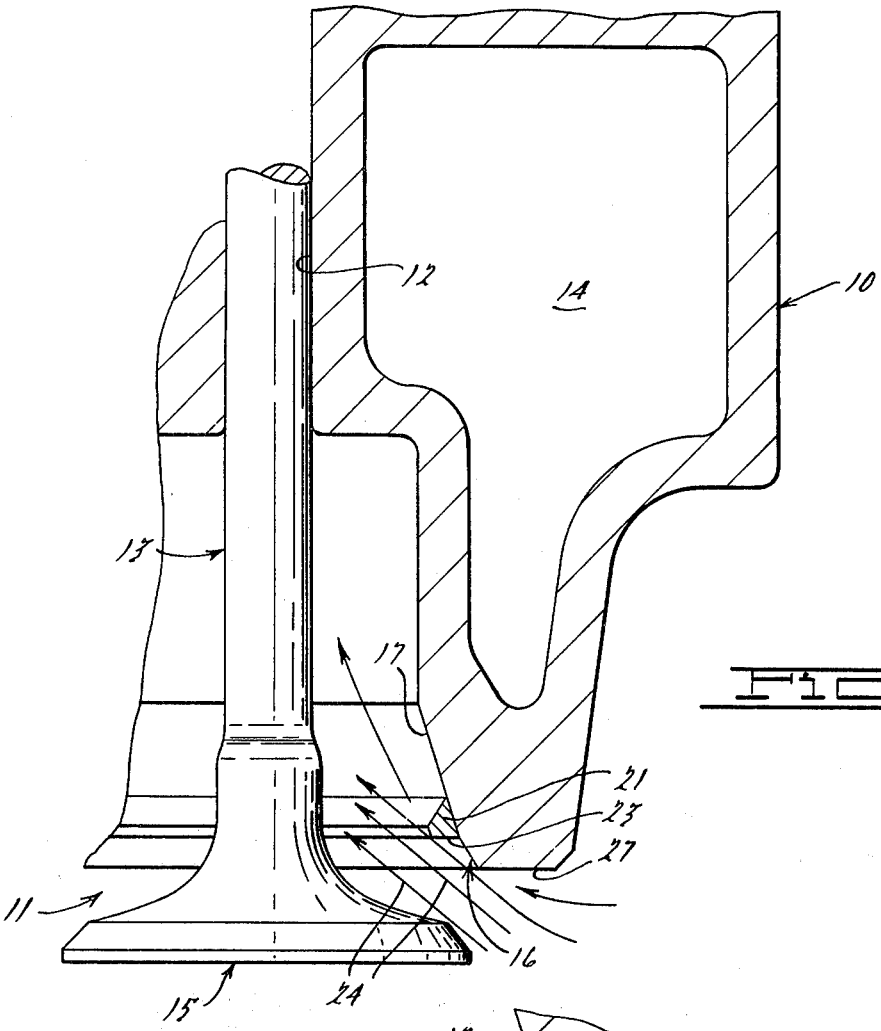
FIG. 1 is a cross section through an overhead valve cylinder head along the center line of an exhaust valve.

In FIG. 1 a fragmentary portion of an internal combustion engine cylinder head is generally indicated at 10. The cylinder head 10 has an exhaust port 11 communicating with a valve guide 12 bored in the head for reception of an exhaust valve 13. The exhaust port is surrounded by a coolant chamber indicated in part at 14.

Exhaust valve 13 is biased toward closed position by the usual valve spring (not shown) in which closed position valve head 15 abuts a valve seat 16.

In a conventional engine cylinder head the exhaust port, as shown in FIG. 3, comprises a throat or passageway defined by a wall 17 of circular cross section. A bevelled valve 16 circumscribes the wall 17 and has an axially extending surface 18 adapted to be engaged by the valve head face 19 to close the exhaust port. The bevelled valve seat 16 extends outwardly from the axis of the throat at an angle to the wall 17.

When the exhaust valve is open, high temperature high velocity exhaust gases flow through the passage bounded by the parallel exhaust valve face 19 and face 18 of the seat 16. Attendant heat transfer film coefficients are very high and the exhaust valve seat and face are raised in temperature with the exhaust valve face 19 temperature at least double that of the water jacketed exhaust valve seat 16 temperature.

The present invention proposes a simple way to force separation of the high temperature exhaust gas stream from the face 18 of the valve 16 so that the resulting film coefficient is lowered whereby the seat operates at a lower temperature. Subsequent closure of the exhaust valve with attendant valve face 19 - seat face 18 contact lowers the exhaust valve face temperature.

Figure 2:
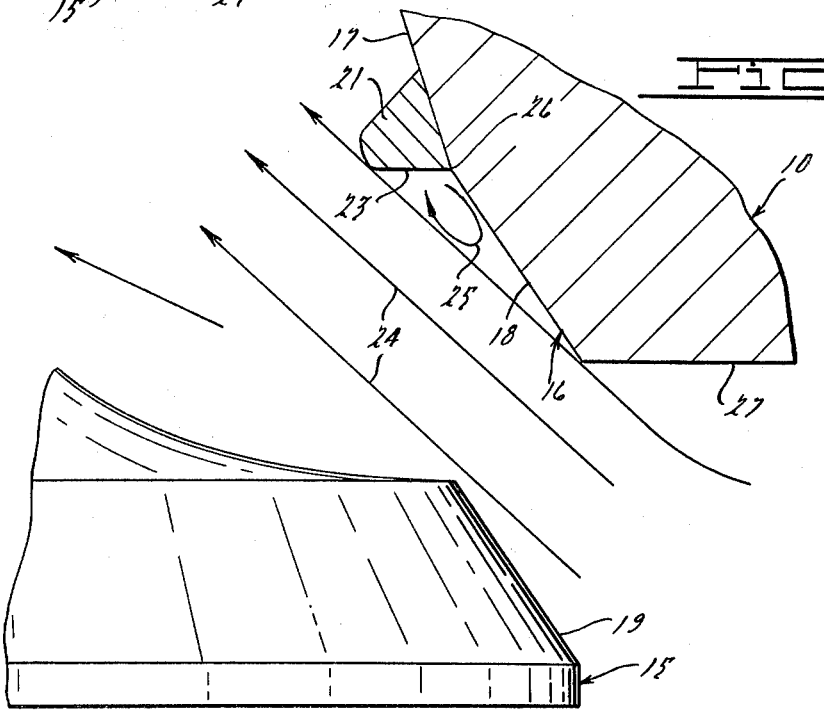
FIG. 2 is an enlarged fragmentary view of FIG. 1 illustrating a first embodiment of an exhaust port embodying the present invention.

As shown in FIGS. 1 and 2 and also in FIG. 4, the exhaust valve port is provided with an annular diverter means 21 (FIG. 2) or 22 (FIG. 4). The diverter means 21 is concentric with the axis of the wall 17 and is mounted or cast within the exhaust port subjacent the valve head 15 engageable face 18 of the valve seat 16. The diverter means has a body configuration having a planar surface 23 projecting into the throat with the planar surface lying normal to the axis of the wall 17. The planar surface intersects the throat wall 17 beneath the edge 26 of the valve seat 16 away from the cylinder head surface 27 through which the valve head 15 moves to open and close the valve port 11. It will be understood that preferably there will be no contact between the valve head 15 and the diverter.

The planar surface 23 lies in the direct path of exhaust gas represented by the arrows 24 flowing into the exhaust port 11 causing separation of the high temperature exhaust gas stream from the valve seat 16 when the valve is open. This may be accompanied by some turbulence as represented by the circular arrow 25 in FIG. 2.

The diverter means 22 of FIG. 4 is shown with a different body configuration than that of the diverter means 21 of FIG. 2. The body configuration is to some extent dependent on whether the diverter is an 'add-on' such as a valve seat insert or is integrally cast in the cylinder head. However mounted, the planar surface 23 of the diverter means controls the flow of exhaust gas to achieve the purpose of the present invention.

It is to be understood this invention is not limited to the exact constructions illustrated and described above, but that various changes and modifications may be made without departing from the spirit and scope of the invention as defined by the following claims.

We claim:

1. A cylinder head having an exhaust valve port comprising a throat defined by a wall of substantially circular cross section, and a bevelled valve seat circumscribing the wall having an axially extending annular surface thereof adapted to be engaged by a valve head to close the port, the bevelled valve seat extending outwardly from the axis of the throat at an angle to the wall, wherein the improvement comprises:

an annular diverter means concentric with the axis of the wall, the diverter means being constructed and arranged to cause separation from the valve seat surface of high temperature exhaust gas flowing into the exhaust port between the valve head and the valve seat when the port is open, whereby when the gas flow is forced to separate from the seat the resulting film coefficient is lowered and the valve seat operates at a lower temperature to provide a cooling effect on the valve seat engaging portion of the valve head when the latter makes contact with the valve seat.

2. A cylinder head according to claim 1 in which:

the diverter means is mounted within the exhaust port subjacent the valve head engageable portion of the valve seat.

3. A cylinder head according to claim 1, in which:

the diverter means has a body configuration having a planar surface projecting into the throat with the planar surface lying normal to the axis of the throat, the planar surface lying in the direct path of exhaust gas flowing into the exhaust port thereby causing separation of the gas flow layer from the valve seat surface engageable by the valve head.

4. A cylinder head according to claim 3, in which:

the planar surface intersects the throat wall beneath the edge of the bevelled valve seat away from the cylinder head surface through which the valve head is movable.

5. A cylinder head having an exhaust valve port comprising a throat defined by a wall of substantially circular cross section, and a bevelled valve seat circumscribing the wall having an axially extending annular surface thereof adepted to be engaged by a valve head to close the port, the bevelled valve seat extending outwardly from the axis of the throat at an angle to the wall wherein the improvement comprises:

an annular diverter means concentric with the longitudinal axis of the throat, the diverter means projecting into the exhaust gas flow path to cause separation of the gas flow layers adjacent the valve seat surface from the latter, the induced turbulence causing separation of the high temperature exhaust gas stream from the valve seat when the valve is open thereby causing the latter to operate at a lower temperature to provide a cooling effect on the valve seat engaging portion when the latter makes contact with the valve seat.

6. A cylinder head according to claim 5, in which:

the diverter means is integral with the throat wall below the valve head engageable portion of the valve seat.

* * * * *